US006786758B2

(12) United States Patent
Chen et al.

(10) Patent No.: US 6,786,758 B2
(45) Date of Patent: Sep. 7, 2004

(54) SECURING DEVICE FOR IMMOBILIZING PLURAL ELECTRIC WIRES

(75) Inventors: Hung-Chi Chen, Taoyuan Shien (TW); Henry Chang, Taoyuan Shien (TW); Dwo Chen, Taoyuan Shien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 10/256,923

(22) Filed: Sep. 27, 2002

(65) Prior Publication Data

US 2003/0224652 A1 Dec. 4, 2003

Related U.S. Application Data

(63) Continuation-in-part of application No. 09/815,926, filed on Mar. 22, 2001, now abandoned.

(51) Int. Cl.[7] ..... H01R 13/58
(52) U.S. Cl. ..... 439/449; 439/942
(58) Field of Search ..... 439/449, 942, 439/456; 174/168

(56) References Cited

U.S. PATENT DOCUMENTS 2,650,948 A 9/1953 Findlay ..... 174/135
3,742,119 A 6/1973 Newman ..... 174/65 G
5,146,532 A 9/1992 Hodge ..... 385/135
5,535,969 A * 7/1996 Duffy, Jr. ..... 248/68.1
6,464,530 B1 * 10/2002 Smith et al. ..... 439/449

* cited by examiner

*Primary Examiner*—Lynn Feild
*Assistant Examiner*—Phuong Dinh
(74) *Attorney, Agent, or Firm*—David Jaffer; Pillsbury Winthrop LLP

(57) ABSTRACT

A securing device for immobilizing plural electric wires is disclosed. The securing device includes a notched supporting member having first and second support sides, and a signal concavity for each of the plural electric wires for allowing the plural electric wires to be placed therein, and a capping member having one end pivotally connected to one end of the notched supporting member, and being in a form of an elongated trough having a top and first and second cap sides extending from the top wherein in operation the capping member extends over a top of the notched supporting member with the first cap side extending over the first support side and the second cap side extending over the over the second support side when the capping member is closed over the notched supporting member for clamping each electric wire between the cap sides of the capping member and the notched supporting member.

10 Claims, 5 Drawing Sheets

SECURING DEVICE FOR IMMOBILIZING PLURAL ELECTRIC WIRES

This is a continuation-in-part application of U.S. patent application Ser. No. 09/815,926, filed on Mar. 22, 2001 abandoned. The present invention is related to a securing device for immobilizing plural electric wires, and more particularly to a securing device for immobilizing plural electric wires applied in an electronic device.

BACKGROUND OF THE INVENTION

1. Field of the Invention

This invention is related to a securing device for immobilizing plural electric wires, and more particularly to a securing device for immobilizing plural electric wires applied in an electronic device.

2. Background of the Invention

Generally, there are many types of electric wires disposed in an electronic device for transmitting electric current or signals. For example, the conducting lines connecting to the power supply of a personal computer are used for providing different electric voltages, e.g. 5V, 12V, GND, −5V and −12V, to different peripheral devices once the personal computer is turned on. Certainly, a securing device disposed in a recession of the power supply is required for immobilizing the plural conducting lines. Because of immobilization of the plural conducting lines, the plural conducting lines are kept orderly from making a mess.

Please refer to FIG. 1. It illustrates a schematic diagram showing how a securing device immobilizes plural electric wires, which connect to an electronic device according to the prior art. The electronic device includes an upper cover 17, a lower casing 12 and a printed circuit board 13. The printed circuit board 13 is mounted in the lower casing 12 for electrically connecting with plural electric wires 18. More specifically, the plural electric wires 18 are connected to a plug 10, which is plugged into a socket 14 of the printed circuit board 13. According to the prior art, the plural electric wires 18 are strapped by a strapping member 19. Once the upper cover 17 and the lower casing 12 are assembled with the securing device 11, the plural electric wires 18 strapped by the strapping member 19 are immobilized by the securing device 11 which is disposed in a recession 15 of the lower casing 12.

However, according to the prior art, the conventional securing device has some disadvantages as follows.

1. Because the electric wires 18 are strapped together by the strapping member 19, heat produced by the electric wires 18 is hard to be dissipated.
2. If one of the electric wires 18 is damaged, it's troublesome for one to recognize the right electric wire, which we intend to replace with another one. In addition, because the electric wires 18 are strapped by the strapping member 19, it's also difficult for one to disassemble the strapped electric wires 18.
3. Each electric wire sustains different extent of strength. The sheathing for preventing the inner conductor of an electric wire from short-circuiting with that of another electric wire is easily to be rubbed off.

Accordingly, it is attempted by the present invention to solve the problems encountered in the prior arts as described above.

SUMMARY OF THE INVENTION

An object of the present invention is to provide a securing device for immobilizing plural electric wires applied in an electronic device.

Another object of the present invention is to provide a securing device for improving the heat-dissipating efficiency of plural electric wires applied in an electronic device.

A further object of the present invention is to provide a securing device for prevent the sheathing of plural electric wires from being rubbed off easily by means of clamping in at least two points.

According to one aspect of the present invention, the present invention is related to a securing device for immobilizing plural electric wires. The securing device includes a notched supporting member having first and second support sides, and a signal concavity for each of the plural electric wires for allowing the plural electric wires to be placed therein, and a capping member having one end pivotally connected to one end of the notched supporting member, and being in a form of an elongated trough having a top and first and second cap sides extending from the top wherein in operation the capping member extends over a top of the notched supporting member with the first cap side extending over the first support side and the second cap side extending over the over the second support side when the capping member is closed over the notched supporting member for clamping each electric wire between the cap sides of the capping member and the notched supporting member.

Preferably, the plural electric wires are connected to a plug plugged in a socket of a printed circuit board.

Preferably, the notched supporting member further includes a first engaging element disposed in the other end thereof, and the capping member further includes a second engaging element disposed in the other end thereof for engaging with the first engaging element of the notched supporting member.

Preferably, the electric wire clamped between the cap sides of the capping member and the notched supporting member is like a 'Ω'-shaped.

According to another aspect of the present invention, the present invention is related to an assembled unit for immobilizing plural electric wires. The assembled unit includes an upper cover, a lower casing adapted to be covered with the upper cover and having a recession disposed on one side thereof, a printed circuit board mounted in the lower casing for electrically connecting with the plural electric wires, and a securing device disposed in the recession of the lower casing for immobilizing the plural electric wires, wherein the securing device includes a notched supporting member having first and second support sides, and a signal concavity for each of the plural electric wires for allowing the plural electric wires to be placed therein, and a capping member having one end pivotally connected to one end of the notched supporting member, and being in a form of an elongated trough having a top and first and second cap sides extending from the top wherein in operation the capping member extends over a top of the notched supporting member with the first cap side extending over the first support side and the second cap side extending over the second support side when the capping member is closed over the notched supporting member for clamping each the electric wire between the cap sides of the capping member and the notched supporting member.

Preferably, the plural electric wires are connected to a plug.

Preferably, the printed circuit board further includes a socket for being plugged with the plug.

Preferably, the electric wire clamped between the cap sides of the capping member and the notched supporting member is like a 'Ω'-shaped.

Preferably, the top of the capping member further includes plural protrusions.

Preferably, the first cap side and the second cap side further include signal concavities respectively.

Preferably, the first support side and the second support side further include plural protrusions respectively.

The present invention may best be understood through the following description with reference to the accompanying drawings, in which:

In the Drawing

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
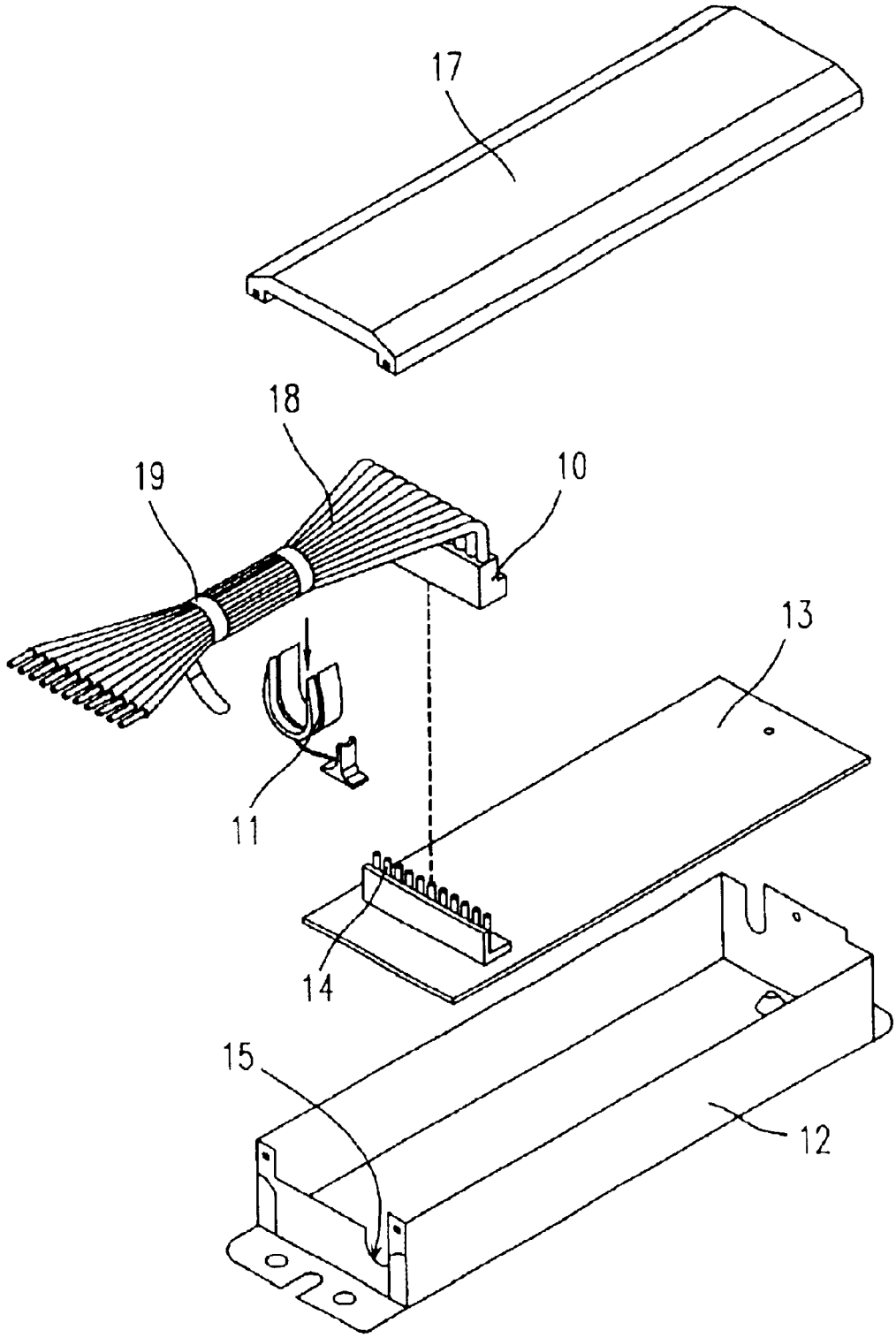
Fig. 1(PRIOR ART)
FIG. 1 is a schematic diagram showing how a securing device immobilizes plural electric wires connected to an electronic device according to the prior art.
Figure 2:
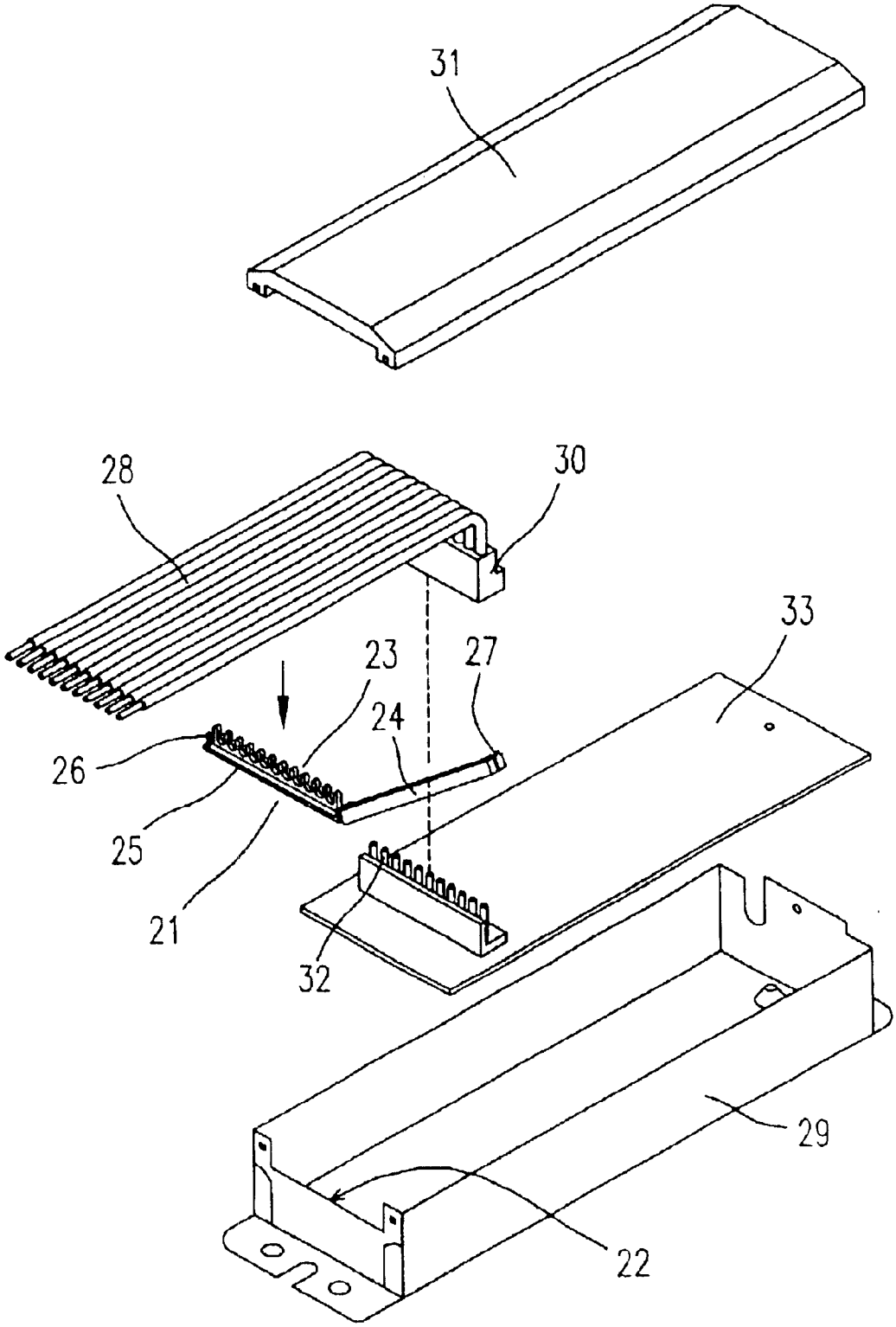
FIG. 2 is a schematic diagram showing how a securing device immobilizes plural electric wires connected to an electronic device according to the present invention.
Figure 3:
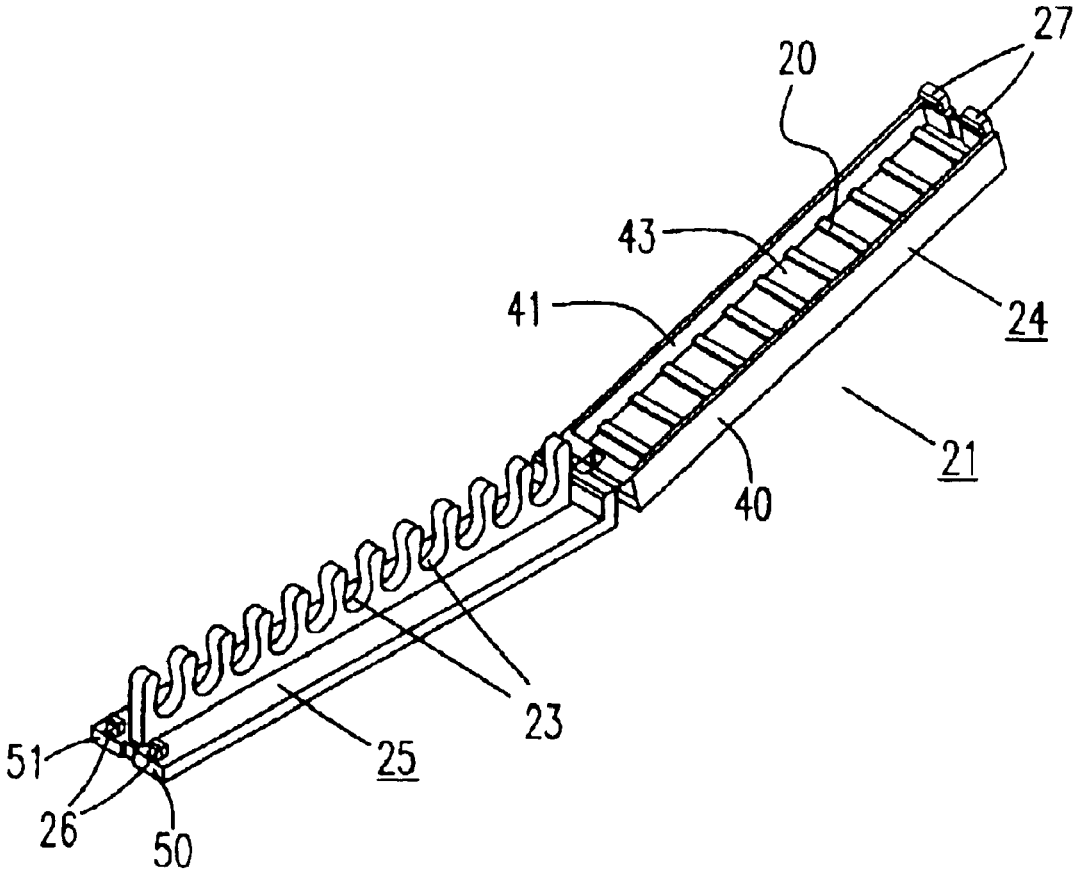
FIG. 3 is an enlarged diagram of the securing device in FIG. 2.
Figure 4:
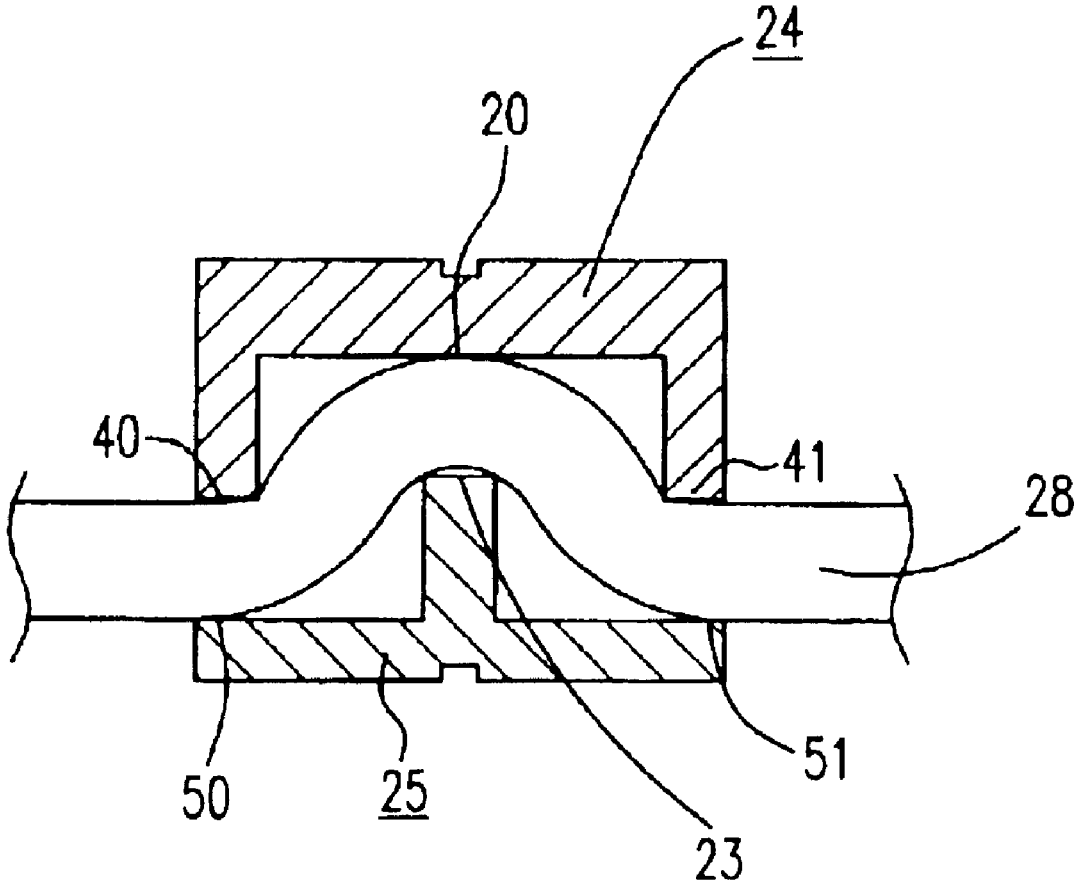
FIG. 4 is a cross-sectional view illustrating the fixing condition when an electronic wire is immobilized in the securing device in FIG. 2.

Please refer to FIG. 2. It is a schematic diagram showing how a securing device immobilizes plural electric wires connected to an electronic device according to the present invention. The electronic device includes an upper cover 31, a lower casing 29 and a printed circuit board 33. The printed circuit board 33 is mounted in the lower casing 29 for electrically connecting with plural electric wires 28. More specifically, the plural electric wires 28 are connected to a plug 30, which is plugged into a socket 32 of the printed circuit board 33. Once the upper cover 31 and the lower casing 29 are assembled with the securing device 21, the plural electric wires 28 are immobilized by the securing device 21, which is disposed in a recession 22 of the lower casing 29. Please refer to FIG. 3. It illustrates an enlarged diagram of the securing device according to the present invention. Meanwhile the securing device 21 includes a notched supporting member 25 having a first support side 50, a second support side 51, and a signal concavity 23 for each of the plural electric wires for allowing the plural electric wires to be placed therein. The securing device 21 further includes a capping member 24 having one end pivotally connected to one end of the notched supporting member 25, and being in a form of an elongated trough having a top 43, a first cap side 40 and a second cap side 41 extending from the top 43. Please also refer FIG. 4. It is a cross-sectional view illustrating the fixing condition when an electronic wire 28 is immobilized in the securing device 21. In operation, the capping member 24 extends over a top of the notched supporting member 25 with the first cap side 40 extending over the first support side 50 and the second cap side 41 extending over the over the second support side 51 when the capping member 24 is closed over the notched supporting member 25 for clamping each electric wire between the cap sides of the capping member 24 and the notched supporting member 25. Preferably, the top 43 of the capping member 24 further includes plural protrusions 20 in response to the signal concavity 23, thereby the wire also being tightly clipped by the protrusion 20 when each electric wire 28 is placed on each concavity 23. Accordingly, the securing member 21 of the present invention fixes and compresses each electric wire 28 in at least two points. As shown in FIG. 4, the electric wire 28 is tightly clamped not only by two cap sides 40, 41 of the capping member 24 and two support sides 50, 51 of the notched supporting member but also by the protrusion 20 of the capping member 24 and the concavity 23. Meanwhile the electric wire 28 fixed in the securing member 21 is like a 'Ω'-shaped, so the electric wire can be more tightly fixed.

Figure 5:
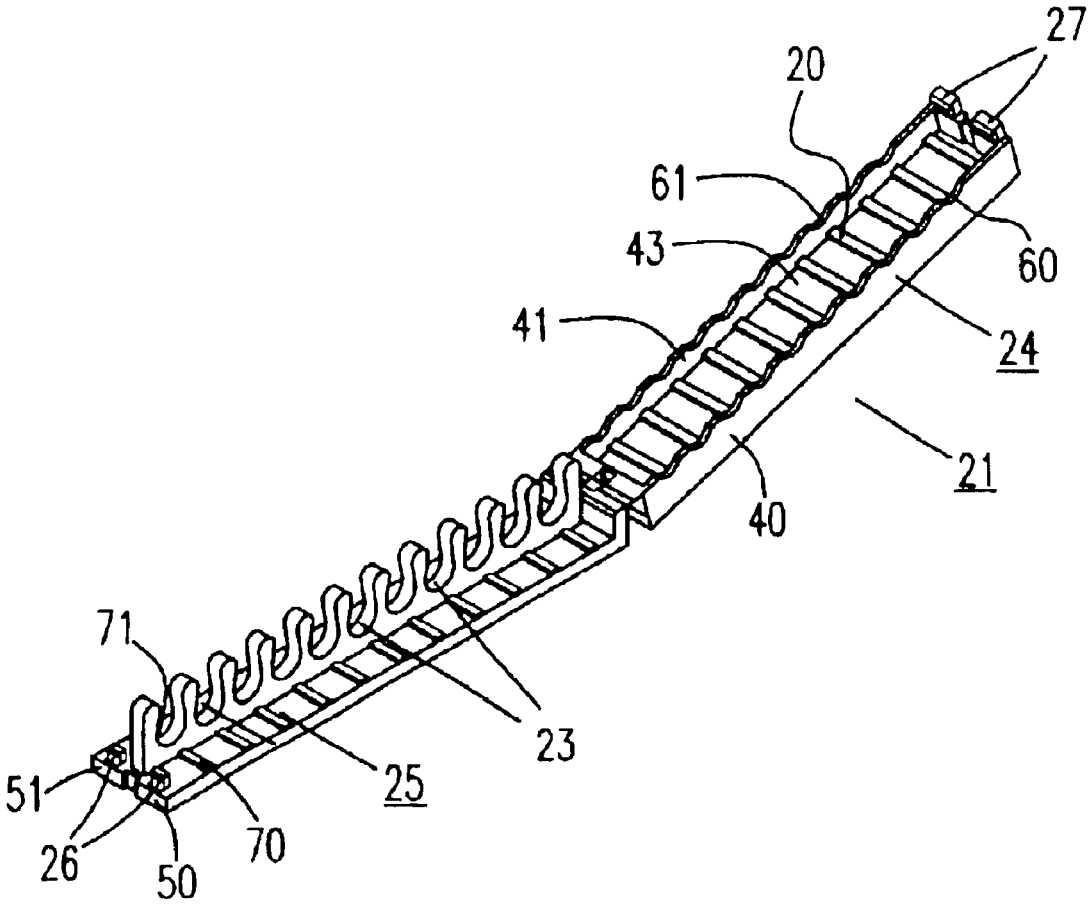
FIG. 5 is a second embodiment of the securing device according to the present invention.

Please refer to FIG. 5. It illustrates another embodiment of the securing device according to the present invention. Preferably, the first cap side 40 and the second cap side 41 both include signal concavities 60, 61. Certainly, the first support side 50 and the second support side 51 both include plural protrusions 70, 71 in response to relative signal concavities 60, 61 of the first cap side 40 and the second cap side 41. Meanwhile the electric wire 28 fixed in the securing member 21 is like a 'Ω'-shaped, so the electric wire can be more tightly fixed.

Preferably, the capping member 24 is formed integrally with the notched supporting member 25.

Preferably, the supporting member 25 further includes a first engaging element 26 disposed in the other end thereof, and the capping member 24 further includes a second engaging element 27 disposed in the other end thereof for engaging with the first engaging element 26 of the supporting member 25.

Therefore, according to the present invention, because the plural electric wires are orderly disposed in parallel with one another, heat produced by the electric wires can be efficiently dissipated. In addition, the electric wires can be apparently recognized, and it's hard for the sheathing of each electric wire to be rubbed off. Thus, the problems encountered in the prior arts are solved.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims that are to be accorded with the broadest interpretation so as to encompass all such modifications and similar structures. Therefore, the above description and illustration should not be taken as limiting the scope of the present invention which is defined by the appended claims.

What is claimed is:

1. A securing device for immobilizing plural electric wires, comprising:

a notched supporting member having first and second support sides, and a signal concavity for each of said plural electric wires for allowing said plural electric wires to be placed therein; and a capping member having one end pivotally connected to one end of said notched supporting member, and being in a form of an elongated trough having a top and first and second cap sides extending from said top wherein in operation said capping member extends over a top of said notched supporting member with said first cap side extending over said first support side and said second cap side extending over said over said second support side when said capping member is closed over said notched supporting member for clamping each said electric wire between said cap sides of said capping member and said notched supporting member, wherein said top of said capping member further comprises plural protrusions, and said first support side and said second support side further comprise plural protrusions respectively.

2. The securing device according to claim 1, wherein said plural electric wires are connected to a plug plugged in a socket of a printed circuit board.

3. The securing device according to claim 1, wherein said notched supporting member further includes a first engaging element disposed in said other end thereof, and said capping member further includes a second engaging element disposed in said other end thereof for engaging with said first engaging element of said notched supporting member.

4. The securing device according to claim 1, wherein said electric wire clamped between said cap sides of said capping member and said notched supporting member is like a 'Ω'-shaped.

5. The securing device according to claim 1, wherein said first cap side and said second cap side further comprise signal concavities respectively.

6. An assembled unit for immobilizing plural electric wires, comprising:

an upper cover;

a lower casing adapted to be covered with said upper cover and having a recession disposed on one side thereof;

a printed circuit board mounted in said lower casing for electrically connecting with said plural electric wires; and a securing device disposed in said recession of said lower casing for immobilizing said plural electric wires, wherein said securing device includes:

a notched supporting member having first and second support sides, and a signal concavity for each of said plural electric wires for allowing said plural electric wires to be placed therein; and a capping member having one end pivotally connected to one end of said notched supporting member, and being in a form of an elongated trough having a top and first and second cap sides extending from said top wherein in operation said capping member extends over a top of said notched supporting member with said first cap side extending over said first support side and said second cap side extending over said second support side when said capping member is closed over said notched supporting member for clamping each said electric wire between said cap sides of said capping member and said notched supporting member, wherein said top of said capping member further comprises plural protrusions and said first support side and said second support side further comprise plural protrusions respectively.

7. The assembled unit according to claim 6, wherein said plural electric wires are connected to a plug.

8. The assembled unit according to claim 7, wherein said printed circuit board further includes a socket for being plugged with said plug.

9. The assembled unit according to claim 6, wherein said electric wire clamped between said cap sides of said capping member and said notched supporting member is like a 'Ω'-shaped.

10. The assembled unit according to claim 6, wherein said first cap side and said second cap side further comprise signal concavities respectively.

* * * * *